US005673636A

United States Patent [19]

Stiefel

[11] Patent Number: 5,673,636

[45] Date of Patent: Oct. 7, 1997

[54] GARBAGE INCINERATION PROCESS ON AN INCINERATION GRATE, INCINERATION GRATE FOR CARRYING OUT THE PROCESS AND PLATE FOR SUCH AN INCINERATION GRATE

[75] Inventor: Jakob Stiefel, Volketswil, Switzerland

[73] Assignee: Doikos Investments Ltd., United Kingdom

[21] Appl. No.: 356,356

[22] PCT Filed: Apr. 14, 1994

[86] PCT No.: PCT/CH94/00075

§ 371 Date: May 31, 1995

§ 102(e) Date: May 31, 1995

[87] PCT Pub. No.: WO94/24487

PCT Pub. Date: Oct. 27, 1994

[30] Foreign Application Priority Data

Apr. 20, 1993 [CH] Switzerland ..... 1231/93

[51] Int. Cl.[6] ..... F23G 15/00

[52] U.S. Cl. ..... 110/346; 110/257; 110/270; 110/273; 110/281; 110/300; 110/101 A; 126/167

[58] Field of Search ..... 110/101 A, 248, 110/251, 255, 257, 268, 270, 273, 281, 285, 300; 126/163 R, 163 A, 167, 174, 175; 414/147, 150, 156

[56] References Cited

U.S. PATENT DOCUMENTS

| | | | |
|---|---|---|---|
| 1,246,639 | 11/1917 | Moore | 110/285 |
| 1,302,368 | 4/1919 | Hopwood | 126/167 |
| 1,518,024 | 12/1924 | Urquhart | 110/281 |
| 2,257,287 | 9/1941 | Thorsell | 126/167 |
| 4,275,706 | 6/1981 | Pauli | 110/268 X |
| 4,732,561 | 3/1988 | Eiring et al. | 110/285 X |
| 4,870,913 | 10/1989 | Schneider | 110/281 X |
| 4,876,972 | 10/1989 | Mrklas | 126/163 R |
| 5,235,921 | 8/1993 | Dunham . | |
| 5,433,157 | 7/1995 | Dittmann et al. | 110/281 X |

FOREIGN PATENT DOCUMENTS

| | | |
|---|---|---|
| 2247134 | 5/1975 | France . |
| 2587092 | 3/1987 | France . |
| 3537945 | 4/1987 | Germany . |
| 8806256 | 8/1988 | WIPO . |

*Primary Examiner*—Henry A. Bennett
*Assistant Examiner*—Susanne C. Tinker
*Attorney, Agent, or Firm*—Speckman, Pauley & Fejer

[57] ABSTRACT

A process wherein an incineration grate is tempered by a medium that flows therethrough. The grate has a number of hollow plates made of sheet metal. Each plate lies on the next underlying plate. A connection pipe is arranged on one side of each plate and a discharge pipe is arranged on the other side of each plate for the flowing medium. The individual plates are crossed by a plurality of tubular elements which open on the top side of the plates. Primary air is supplied to the materials to be incinerated through the tubular elements. Primary air supply is individually dosed to each tubular element.

16 Claims, 5 Drawing Sheets

GARBAGE INCINERATION PROCESS ON AN INCINERATION GRATE, INCINERATION GRATE FOR CARRYING OUT THE PROCESS AND PLATE FOR SUCH AN INCINERATION GRATE

BACKGROUND OF THE INVENTION

1. Field of the Invention

This invention relates to a process for incinerating garbage on an incineration grate. This invention also relates to an incineration grate for executing the process and to a single incinerator grating plate, a plurality of which permits the manufacture of a corresponding incineration grate.

2. Description of Prior Art

Incineration grates for incinerating garbage are known. A type of incineration grate is the pusher incineration grate which includes movable parts for making stoking movements, by which the material to be incinerated is conveyed on the grate. The forward pusher grates are to be distinguished from the reverse pusher grates. The materials to be incinerated are conveyed in a forward direction on the forward pusher grates and in a reverse direction on the reverse pusher grates. The forward and reverse pusher grates which are inclined downward in the forward direction have been known for decades and have been widely distributed in garbage incineration plants. Although the present invention generally relates to incineration pusher grates, regardless of whether they convey the materials to be incinerated in the forward or the reverse direction with respect to the loading direction, the forward pusher grate will be discussed first.

An easy way to imagine such a conventional forward pusher grate is to first imagine a simple tile roof of a house. The individual tiles of the house represent the individual grate rods of the forward pusher grate, while a horizontally extending row of tiles of the house corresponds to a horizontally extending row of grate rods which together respectively form a single grating stage. Each grating stage overlaps the next grating stage which is positioned below it. The individual grate rods are constructed of cast chromium-steel and are suspended from transverse pipes, similar to roof tiles on roof laths. The typical angle of inclination of an incineration forward pusher grate is approximately 20 degrees, but can be more or less inclined. Every second grating stage of such a forward pusher grate is fixed in place, and the grating stages disposed in between such fixed grating stages are mechanically movable. A mechanical drive device provides that each such movable second grating stage makes stoking movements. Such a stoking movement is a linear back and forth movement of the grate rods of an individual grating stage in a plane of the top of the movable grate rods. The stoking movements extend for some centimeters and in relation to the inclination of the grate rods the direction of movement extends in and opposite to the fall line on the inclined surface of the grate rods. The stoking movements cause the burning garbage on the forward pusher grate to be continuously shifted during a long retention time of 45 to 120 minutes and also cause even distribution on the grate. Garbage is fed from an upper end of the grate. The incoming garbage in this feeding area is first dried by radiation heat. This is followed by an area on the forward pusher grate where gasification is started, in which the solid parts of the garbage change into the gaseous state and release energy.

A reverse pusher grate can also be imagined as a slate roof of a house, but with a reversed inclination. Therefore, with respect to the inclination, instead of an upper tile or upper grate rod overlapping a lower grate rod, a lower grate rod with respect to the inclination overlaps an adjacent upper grate rod. Such a reverse pusher grate has an advantage in that the glowing mass of garbage is pushed back toward the front of the grate during the stoking movements. The primary incineration extends overlappingly from the front of the grate to an end of the grate. This intense garbage fire, starting directly at the front of the grate, is an essential feature of a reverse pusher grate. The intense fire is generated by bringing burning portions of the garbage together and mixed with not yet ignited portions of garbage yet to be burned, by which a zone of very high temperature and great combustion intensity is generated at the start of the grate. The stoking movement includes a natural downward movement of the materials to be incinerated because of the force of gravity, and of the oppositely acting pushing movement of the grate. It is possible to generate a buffer effect with respect to the variations in the calorific value of the materials to be incinerated, in that a break in the ignition or a flight of the fire in the direction towards the end of the grate is prevented. Such reverse pusher grates generate a burning layer of material of even height without causing gaps between the material, which would leave the grate uncovered at those gaps and would result in thermal waste.

In either type of grate, the individual grate rods are constructed of cast chromium-steel, which is intended to assure high wear and heat resistance. The grate rods are surface-ground on lateral faces so that the grate rods lie close to each other and achieve a high flow resistance of the material on the grate with respect to the primary air flowing in from below, along with the least possible amount of material fall-through. A primary air flow enters a combustion bed in an area of the front end of the grate rod through a gap formed in the lateral surface. The front end of the grate rod is brushed over by the next overlapping grate rod, which is intended to keep the air gaps open. In order to achieve an additional cleaning effect, the back and forth movement of adjoining grate rods is somewhat shifted in phase so that a relative movement takes place between the adjoining grate rods which helps in keeping the ventilation slits open. A combustion air supply, which is defined, if possible, at any time and at each place of the grate, is the most important condition for the operation of a garbage incineration grate which is intended to have the lowest possible emissions. To achieve this, the primary air is supplied to the combustion bed by three to six separate air zones, in a long direction of the grate. With more modern installations, the supply of combustion air to each such individual air zone is separately measured and controlled. In such installations, this is achieved either by supply pipes with Venturi measuring points or by pressure measurements at individual baffles assigned to each primary air zone. In this way an exact control of the conditions of the air at each place under each grate is assured. Additional air is supplied for combustion in the form of secondary air from above the grate. This secondary portion of the air is approximately 25 to 35% of the total combustion air and is supplied to the material to be burned from above through air nozzles of 50 to 90 mm in diameter. The average operating temperature of the grate rods in the main combustion zone of the grate is approximately 50° C. above the set temperature of the primary air, or approximately 200° C. However, the surface must withstand temperatures of 800° to 1100° C. For practical purposes the service life of a grate rod depends on its mechanical, thermal and chemical (including oxidation in an acid medium) wear resistance. Depending on the manufacturer of the grate rod, between 5000 and 35000 hours of service can be achieved. Because the grate rods are subject to considerable dilatation on account of the large temperature differences between operational and non-operational states, which has a direct effect on the grate width, a reverse pusher grate has compensating elements. Such compensating elements include movable center plates and movable lateral plates of the grate which can compensate for such dilatation.

SUMMARY OF THE INVENTION

It is one object of this invention to provide a process which permits a more optimal incineration of garbage on an incineration grate by controlling the primary air supply in such a way that an optimal temperature spectrum in the combustion chamber is achieved, and thus better utilizes the calorific value of the garbage to be incinerated. It is also one object of this invention to provide a grating plate, with which it is possible to construct an incineration grate which is cost-effective to manufacture, and is subjected only to minimal dilatation so that respective compensation segments are unnecessary, and also has less grate material fall-through than conventional incineration grates.

The process according to one preferred embodiment of this invention includes incinerating the garbage on a pusher incineration grate having a plurality of grating stages of a plurality of hollow grating plates, redistributing and conveying the garbage with stoking movements of the hollow grating plates with respect to each other, and tempering each hollow grating plate with a liquid medium that flows through an interior of each hollow grating plate.

A grating plate according to one preferred embodiment of this invention includes a generally square hollow body, at least one supply connector and at least one exhaust connector positioned on an underside of the generally square hollow body, for supplying and exhausting a medium that flows through the generally square hollow body.

An incineration grate according to one preferred embodiment of this invention includes a plurality of grating plates that extend across an entire grate width of the incineration grate, at least one grating plate overlapping and supported by a first adjoining grating plate, and at least one grating plate overlapped by and supported by the second adjoining grating plate.

Preferred embodiments of a process, a grating plate, and an incineration grate of this invention will be described in conjunction with the drawings, wherein.

Figure 3A:
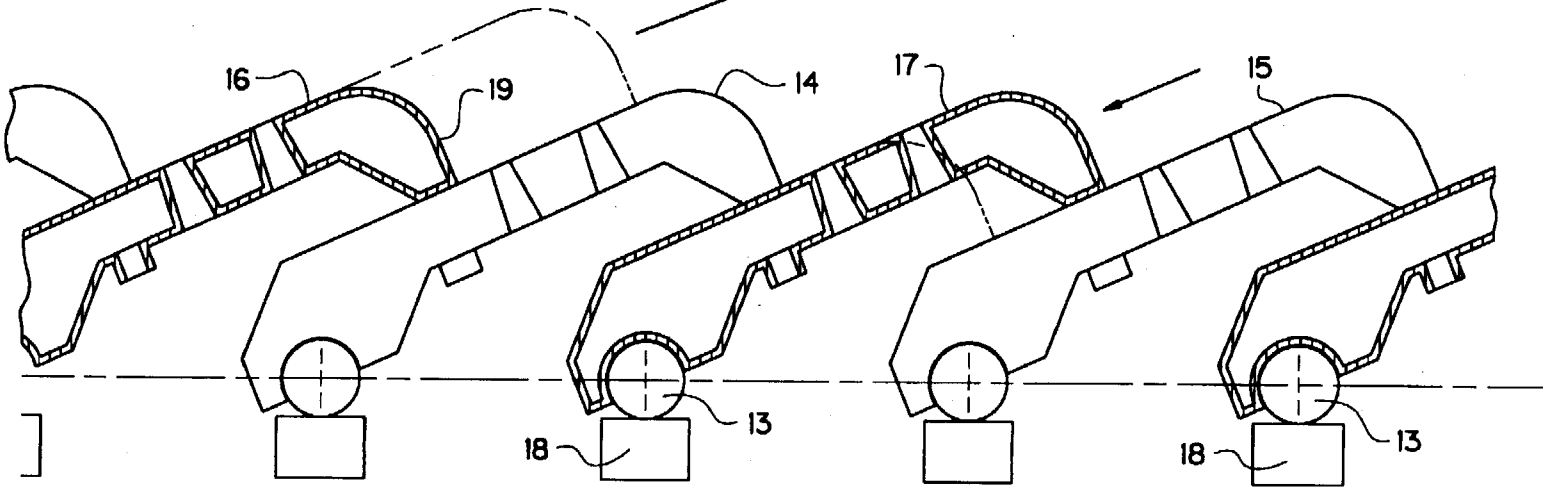
Figure 3B:
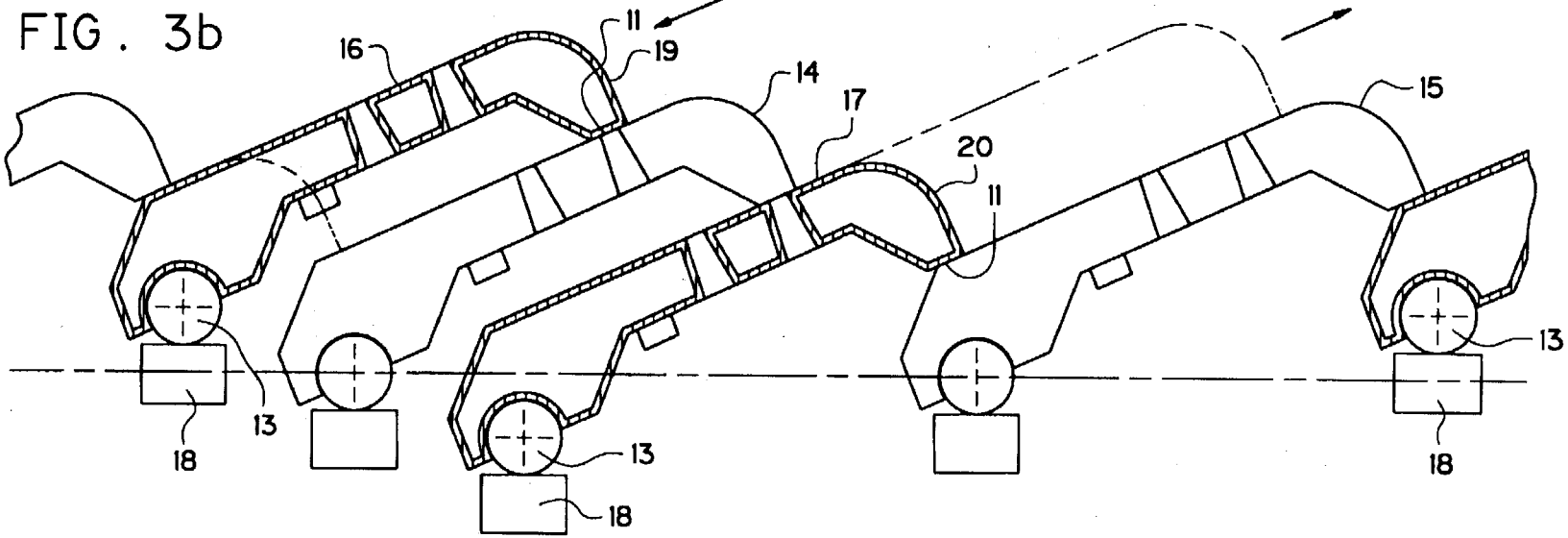
Figure 4:
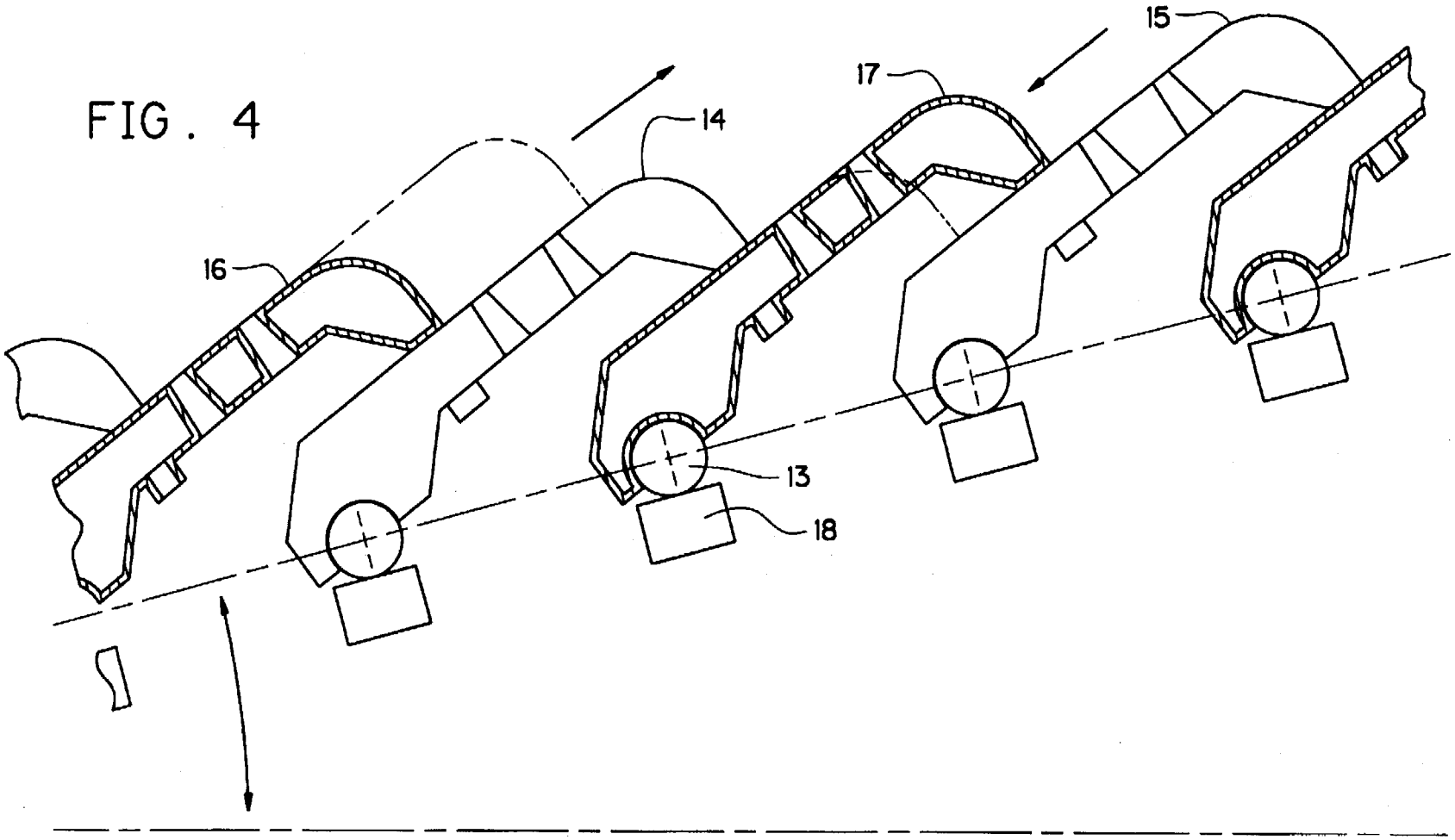
Figure 5:
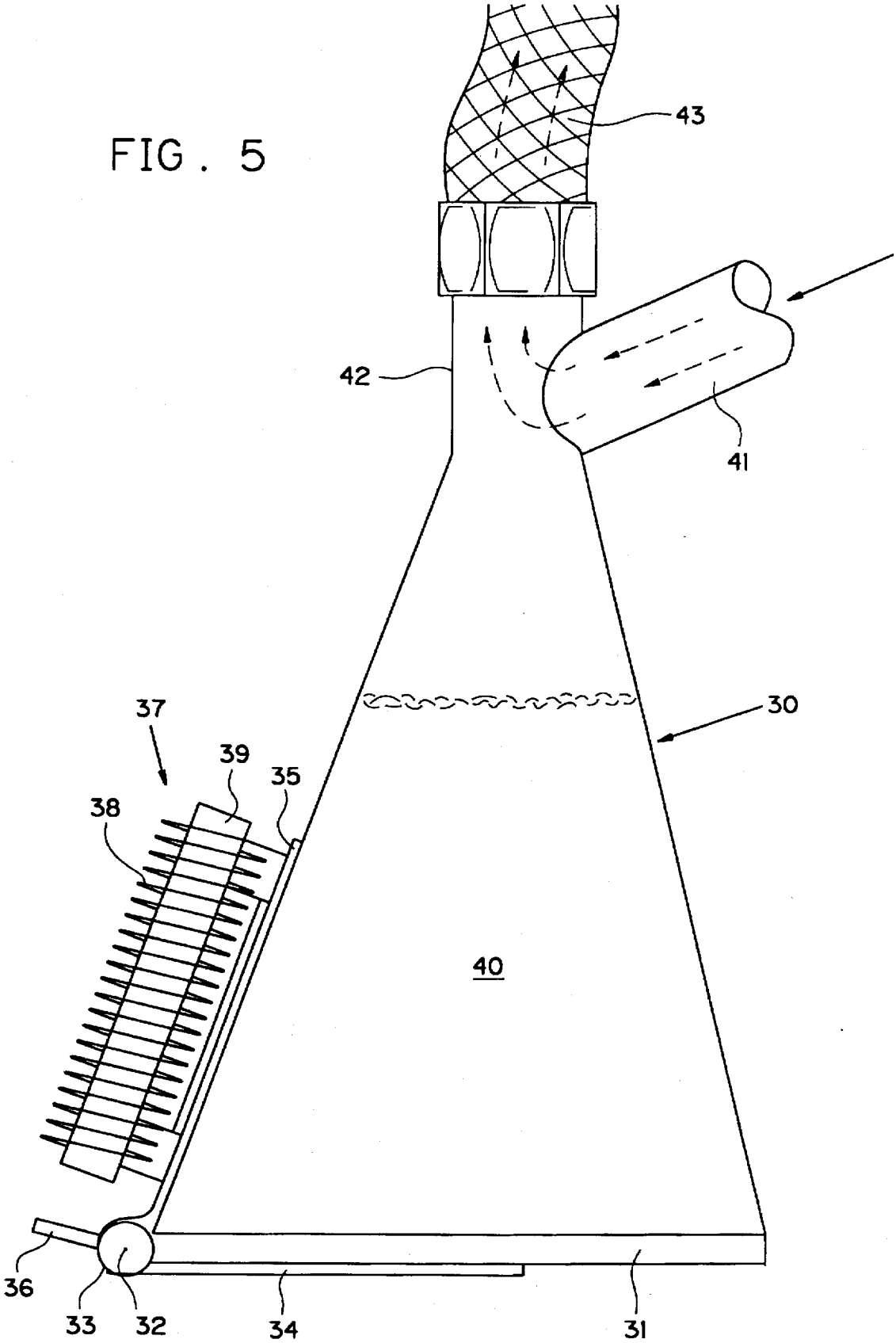

FIG. 3*a* shows a schematic cross-sectional view of an incineration grate constructed of a plurality of grating plates at one instantaneous view in the operation of the incineration grate whose movable grating plates perform stoking movements, according to one preferred embodiment of this invention;

FIG. 3*b* shows a schematic cross-sectional view of the incineration grate shown in FIG. 3*a*, at another instantaneous view in the operation of the incineration grate;

FIG. 4 shows a schematic cross-sectional view of an inclined incineration grate constructed of grating plates as a reverse pusher grate, according to another preferred embodiment of this invention; and FIG. 5 shows a side view of a primary air supply syphon installed underneath an incineration grate, a grate material fall-through container and a device for emptying the container by remote-control, according to another preferred embodiment of this invention.

DESCRIPTION OF PREFERRED EMBODIMENTS

Figure 1:
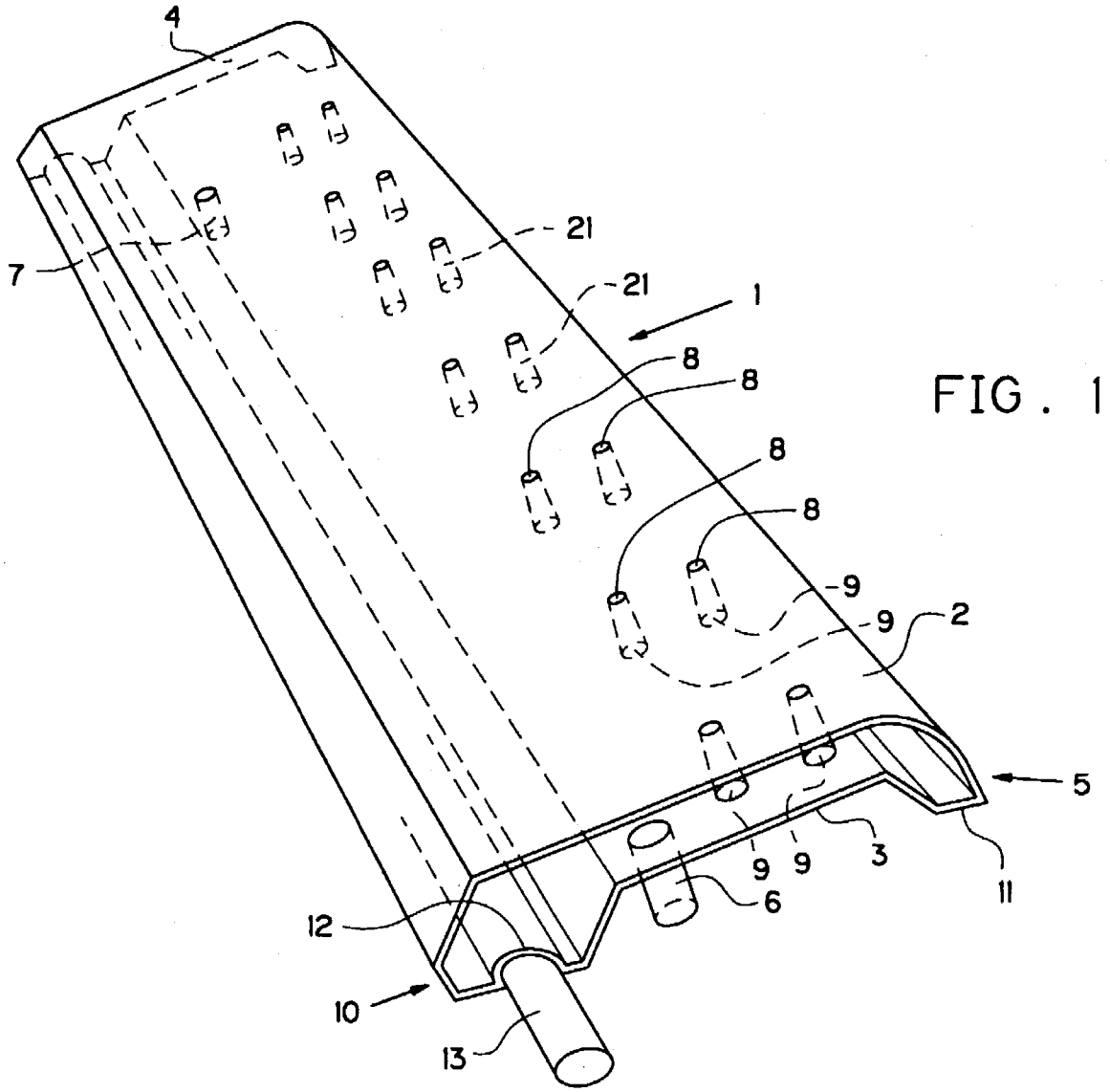
FIG. 1 shows a perspective view of an individual grating plate of an incineration grate, according to one preferred embodiment of this invention.

To help explain the process in accordance with one preferred embodiment of this invention, first the grating plate of the process, as well as the incineration grate constructed from such grating plates will be described. An individual grating plate of such an incineration grate, according to one preferred embodiment of this invention, is shown in a perspective view in FIG. 1. One preferred embodiment of the grating plate 1 comprises two sheet metal shells: a top shell 2 of the grating plate 1 and a bottom shell 3 of the grating plate 1. The two sheet metal shells 2, 3 can be welded together. The edges of the two shells 2, 3 can be advantageously formed so that it is possible to slightly turn the edges of the two shells 2, 3 into each other. The two ends of the hollow profiled section created in this way can be sealingly welded together with sheet metal end plates. The rear end plate 4 is shown in FIG. 1, while the front end of the hollow profiled section is shown open to allow a view of the interior of the hollow profiled section. After closing both ends of the hollow profiled section, a hollow chamber sealed from the exterior of the hollow profiled section is formed in the interior of the grating plate 1. Two connectors 6, 7 for connecting a supply line and an exhaust line so a medium can flow through the grating plate 1 are located on the grating plate underside 3. The medium can be used for tempering the grating plate 1 and preferably is a fluidic medium, i.e. a gas or a liquid. For example, a coolant can flow through the grating plate 1. The coolant can be water or oil or another liquid suitable for cooling. According to another preferred embodiment of this invention a liquid or gas can be used to heat the grating plate 1. Thus the medium can be employed for cooling as well as heating, or, in other words for tempering the grating plate 1. Openings 8, 9 are located on the top shell 2 of the grating plate 1 and the bottom shell 3 of the grating plate 1, wherein the openings 8 on the top shell 2 are narrower than the openings 9 on the bottom shell 3. The openings 8, 9 located opposite each other on the top shell 2 of the grating plate 1 and the bottom shell 3 of the grating plate 1 are tightly connected with each other by pipe-shaped elements 21. According to one preferred embodiment of this invention, conical pipe elements 21 have a circular, elliptical or slit-shaped diameter, wherein each element 21 is welded to the top shell 2 of the grating plate 1 and to the bottom shell 3 of the grating plate 1. By being charged with air from the direction of the bottom shell 3 of the grating plate 1, the funnel-shaped through-puts created in this manner allow the directed ventilation of the material to be incinerated on the grating plate 1. Supply pipes or supply hoses for the air can be connected for this purpose to the individual openings 9 of the continuous pipes on the bottom shell 3 of the grating plate 1. The grating plate 1 shown in FIG. 1 has such a cross section that a generally flat surface is formed on the top shell 2 of the grating plate 1. The material to be combusted can be placed on the generally flat surface. The bottom shell 3 can have edges so that bases 10, 11 can be formed. The base 10, can, as shown in FIG. 1, contain a channel 12. A round rod 13 can extend into the channel 12, and the grating plate 1 can be supported by the round rod 13. The other base 11 can be level on the bottom and thus rest on an adjoining grating plate 1, which has a similar shape.

According to another preferred embodiment of this invention, a grating plate 1 can comprise a pre-fabricated hollow profiled section wherein only the two ends of the pre-fabricated hollow profiled section are welded shut with fitted end plates. Funnel-shaped continuous pipe elements 21 can be welded in later, after correspondingly narrow holes 8 are machined or drilled in the top of the grating plate 1 and corresponding slightly larger holes 9 are machined or drilled in the underside of the grating plate 1. The funnel-shaped pipe elements 21 can then be pushed from the side of the larger holes through the grating plate 1, which can then be sealingly welded together with the exterior of the grating plate 1. Pipe elements 21 are preferably conical or funnel-shaped, so that the adhesion of the miscellaneous grate fall-through can be practically eliminated, since, because of the conicity of the pipe elements 21, the ends of the pipe elements 21 will preferably extend beyond the surface of the grating plate 1. Subsequently the openings 8, 9 can be surface-ground with the surface of grating plate 1. Connecting pipes or connecting hoses can be connected to the bottom of these continuous pipe elements 21.

Manganese-alloy sheet metal, for example, having a thickness of approximately 10 millimeters, is suitable to assure the heat resistance of the grating plate 1. In addition, the sheet metal plate should have a sufficiently good heat conductivity so that large temperature differences do not exist within the grating plate 1 and in this way stresses in the material are avoided. Regardless of whether the grating plate 1 comprises two half-shells or a prefabricated hollow profiled section, the grating plate 1 of this invention can be manufactured more cheaply than a stage of a conventional grate which includes a plurality of grate rods, because the single grating plate 1 replaces several conventional grate rods. The grating plate 1 replaces the grate rods of a single conventional grating stage and the grating plate 1 represents the entire grating stage. Because of this, slits between individual movable elements do not arise, such as occurs with conventional grate rods, and thus, the grating plate according to one preferred embodiment of this invention considerably reduces grate fall-through. In conventional grating stages having individual grate rods, a piece of garbage can become stuck in a slit between two grate rods and result in a wide slit, while the smaller slits between the remaining grate rods can become almost completely sealed, so that practically no primary air can pass through the grate. The primary air thus flows almost completely through the widened slit, and the fire has steep flame points above this widened slit, which is undesirable. Further, the grate fall-through can be considerable at the widened slit. These problems are eliminated by a continuous grating plate 1 which constitutes the entire grating stage. However, according to one preferred embodiment of this invention, the individual grating plates 1 are individual grate rods, and are disposed next to each other, and thus constitute an entire grating stage. Thus, each grating stage comprises a plurality of grating plates 1 which are positioned in rows adjacent to each other and together constitute an entire grate width of an incineration grate. The respective grating plates 1 of a grating stage overlap and are supported by the grating plates 1 of a neighboring grating stage, which are overlapped by and support grating plates 1 of neighboring grating stages.

Figure 2:
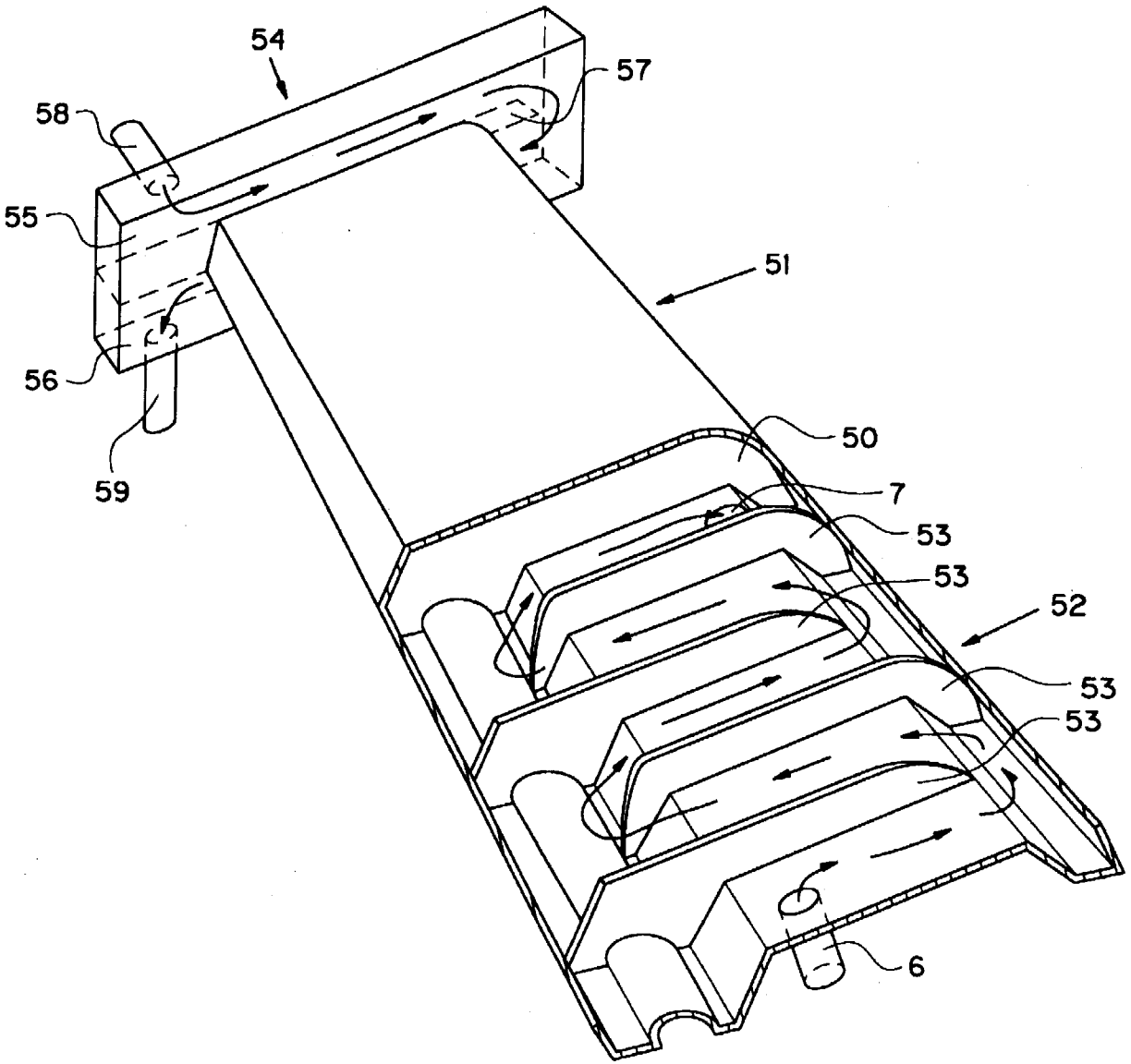
FIG. 2 shows a partial cross-sectional view of an individual grating plate of an incineration grate with baffle plates, partially in section, according to one preferred embodiment of this invention.

A grating plate 1 according to another preferred embodiment of this invention is shown partially in section in FIG. 2. The grating plate 1 is divided into two chambers 51, 52 by a separating plate 50. The grating plate 1 according to another preferred embodiment of this invention is installed in a first portion of an incineration grate where no primary air supply is used, and thus the grating plate 1 shown in FIG. 2 does not contain pipe-shaped elements 21 or openings 8, 9. Generally, incineration grates have three to six different zones, each zone having a number of grating plates, and primary air only being supplied beginning at the second zone. Baffles 53 can be installed in an interior of the two chambers 51, 52. A bottom edge of the baffles 53 can be sealingly welded to the grating plate 1. An air gap of a few tenths of a millimeter between a top edge of the baffles 53 and the top of the grating plate 1 can be maintained so that a gas exchange can take place through the air gaps, inside the labyrinth formed by the baffles 53. A cooling medium is preferably pumped into the chamber 52 through a supply connector 6. The cooling medium, as indicated by the arrows, flows through the labyrinth formed by the baffles 53 and flows out of the chamber 52 through the connector 7. Because the cooling medium encounters an increased surface area for absorbing heat, an improved heat exchange results. Water, for example, can be used as the cooling medium. The interior of the chamber 51 is similar to the interior of the chamber 52. According to another preferred embodiment of this invention a grating plate 1 with an interior labyrinth is penetrated by pipe-shaped elements, so that openings for blowing in primary air are present.

Planks 54 can be disposed on two lateral edges of the grating plate 1. The movable grating plates 1 can be pushed back and forth along the planks 54. As shown is FIG. 2, each plank 54 comprises two square pipes 55, 56 placed on top of each other, wherein an intermediate wall 57 is shortened at one end, so that a connection between interiors of the two square pipes 55, 56 is formed. Cooling medium can be pumped from a connector 58 through the plank 54. The cooling medium preferably flows through the two square pipes 55, 56 as indicated by the arrows shown in FIG. 2 and flows out of the plank 54 through the connector 59. Further, it is possible to dispose a screening plate, not shown in FIG. 2, between the plank 54 and the grating plate 1, which encloses the plank 54 on a side of an incineration plate and is used as a wear element for the friction generated between the grating plate 1 and the plank 54.

A schematic cross section of an incineration grate according to one preferred embodiment of this invention having a plurality of grating plates 14, 15, 16, 17 is shown in FIGS. 3*a* and 3*b*. FIGS. 3*a* and 3*b* show two different instantaneous views in the operation of such an incineration grate, whose movable grating plates 14, 15, 16, 17 perform stoking movements. The grating plates 14, 15 shown in solid lines are stationary while the grating plates 16, 17 shown in cross-hatched cross section are movable. The movable grating plates 16, 17 can perform stoking movements by moving back and forth, as indicated by the arrows shown in FIGS. 3*a* and 3*b*. Driving can be accomplished by the round rods 13 which are fastened on profiled sections 18, which in turn can be moved back and forth by a mechanical drive element.

In FIG. 3*a*, the grating plates 14, 15, 16, 17 are in identical positions. The movable grating plates 16, 17 move out of this position as indicated by the arrows. The grating plate 16 thus moves upward toward the right and a front end 19 pushes the material to be incinerated. The material is pushed across the lower grating plate 14 from its front end 19, and is conveyed toward the right. Thus, the material is displaced opposite the general conveying direction or in the general conveying direction, depending on whether a reverse pusher grate or a forward pusher grate is used. The grating plate 17 is also a movable grating plate. The grating plate 17 then moves to the left and the base 11 passes across the upper openings of the primary air supply on the grating plate 15 located underneath the grating plate 17. This passage across the openings causes a cleaning effect.

Another instantaneous view is shown in FIG. 3*b*. The grating plate 16 has reached an upper position. The grating plate 17 has reached a lowest position, and base 11 rests on a lower area of the top of the grating plate 15. The grating plate 17 will be displaced in the direction of the arrows during the next stoking movement and will push the material to be incinerated ahead of the front end 20.

The incineration grate as shown in FIGS. 3*a* and 3*b* is horizontal in relation to the general direction of material conveyance, and is a forward pusher grate, because the materials to be incinerated are conveyed by the grate or by the moving grating plates, every second one of which is movable and executes stoking movements.

A reverse pusher grate, according to another preferred embodiment of this invention, is shown in FIG. 4. The incineration grate is constructed of a plurality of incineration grating plates 14 to 17, and is inclined by about 25° on one side. The grating plates 14, 15, 16, 17 push the materials to be incinerated upward against the general conveying direction by the stoking movements they perform. Thus the material to be incinerated, which, due to the force of gravity slowly moves downward, is continually slightly pushed back by the stoking movements and in the process is redistributed, which aids complete incineration. Depending on the requirements, an incineration grate made of such grating plates can be made horizontally, downwardly, or upwardly inclined.

FIG. 5 shows an individual primary air supply syphon 30, according to one preferred embodiment of this invention, that can be installed below the incineration grate on the individual lower openings 9 of the pipe-shaped elements 21 which penetrate the incineration grate. An individual primary air supply line 41 passes through the supply syphon 30. Since it is largely unavoidable that some material 40 will fall downward through the small openings in the grating plates, without a supply siphon 30, this material 40, in the form of a finely powdered slag, would fall into the primary air supply lines. Thus, it is necessary to provide the primary air supply syphon 30, which catches the material 40 and permits unhampered continuous air supply at the same time. According to one preferred embodiment of this invention, the lower end of the syphon 30 is conical, similar to the shape of an Erlenmeyer flask, and a bottom of the syphon 30 can be closed off by a spring-loaded flap 31. The flap 31 can be pivoted around a hinge 32, and a leg 34 of a spring 33 applies pressure from below against the flap 31, and another leg 35 of the spring 33 applies pressure against a side wall of the syphon 30. An actuating lever 36 fixedly connected with the flap 31 extends away from the hinge 32 and is located in a range of action of a solenoid 37. Coil 38 can be charged with electric current, which causes the electromagnet to attract the actuating lever 36 against a core 39, and the flap 31 can be open and collected material 40 can fall into a collection trough. In an upper portion of the syphon 30 the primary air supply line 41 preferably leads into the interior of the syphon 30. Air supply line 41 leads, preferably downwardly inclined, into the syphon 30 so that material 40 cannot fall into the supply line 41, since a strong flow of air does not necessarily continuously flow through the supply line 41. A neck 42 of the syphon 30 is sealingly connected by a short, heat-resistant flexible line 43 to a lower opening 9 of a single pipe-shaped element 21 leading through the grating plate 1. Thus, the syphons 30 are suspended directly underneath the grating plate 1 by the flexible line 43.

The process, according to one preferred embodiment of this invention can now be described. Fluidic media, such as gases and liquids, are preferably used as a tempering medium for the incineration grate. The process maintains the temperature of the incineration grate at a constant level and considerably reduces the incineration grate's wear. Thus the temperature is preferably in a range up to approximately 150° C., which results in low thermal stress of the material and has a corresponding positive effect on the mechanical stability and wear resistance of the grating plates 1. In accordance with one preferred embodiment of the process of this invention, the fluidic medium used for tempering can exchange heat with the primary air that is supplied. A conventionally available heat exchanger operating in accordance with the counter-flow principle can be used for this. It is possible with such a heat exchanger to pre-heat the primary air which aids optimal incineration with certain materials to be incinerated. Since heated primary air improves incineration, pre-heating of the primary air is very much desirable in connection with organic components of the garbage, such as with rotting or decayed vegetables or fruit. It is also possible in a reversed direction of the heat flow to heat the incineration grate, for example for starting an incineration process, in order to bring the incineration grate to the optimum operational temperature as quickly as possible. For this purpose the tempering medium can absorb the heat from the exhaust air of the incineration taking place and can then transfer the heat into the grating plates 1 of the incineration grate.

Another aspect of the process in accordance with one preferred embodiment of this invention comprises supplying the material to be incinerated with primary air, so that the calorific value of the material is used as intensely as possible and its incineration takes place as completely as possible. For this purpose the temperature spectrum in the combustion chamber above the incineration grate is determined by a plurality of temperature measuring sensors. The measuring sensors can be installed in a surface of the grating plates 1. According to another preferred embodiment of this invention, it is possible to determine the temperature spectrum contactless by means of a pyrometer. By directed metering of the primary air supply for each individual supply line, of which there is a large number in the incineration grate in accordance with one preferred embodiment of this invention, it is possible to bring the actual temperature spectrum in the combustion chamber into close approximation to the optimal spectrum. It is, for example, possible to position magnetic valves in the primary air supply lines for the individual control of the primary air supply for each supply line. The magnetic values can be controlled by a central microprocessor, in which the optimally selected combustion chamber temperature spectrum is stored. By continuous measuring of the actual spectrum and comparison with the ideal spectrum it is possible to form a control circuit by which the individual magnetic valves can be individually closely metered and variably opened to allow primary air flow through the individual supply lines. The primary air supply can be supplied by one or several efficient compressors or fans.

The process in accordance with one preferred embodiment of this invention makes greatly improved incineration possible and thus better utilization of the calorific values of the various materials to be incinerated. It is also possible to improve the flue gas values, because the process preferably takes place with a reduced excess of oxygen and reduced $CO_2$ content in the flue gas. A considerable increase in the service life of the incineration grates can be achieved by tempering, and in particular cooling the grating plates 1. The incineration grate in accordance with one preferred embodiment of this invention, because of its construction with individual grating plates 1, is simple and much more cost-efficient than conventional incineration grates having a plurality of grate rods which can be moved with respect to each other and which are additionally subjected to great mechanical and thermal wear. For example, a problematic dilatation is practically eliminated according to the process of this invention by keeping the temperature constant at a comparatively low level and the elaborate steps necessary in conventional incineration grates for compensating these dilatations can therefore be omitted. The grate material 40 fall-through is greatly reduced when employing incineration grates according to one preferred embodiment of this invention, because many, small supply openings for directing primary air are present. These many, small supply openings provide a relatively strong air flow, so that a large amount of grate material 40 fall-through does not occur.

I claim:

1. A process for incinerating garbage on a pusher incineration grate, the steps comprising: incinerating the garbage on a pusher incineration grate comprising a plurality of grating stages having a plurality of hollow grating plates (1, 14, 15, 16, 17), redistributing and conveying the garbage with stoking movements of the hollow grating plates (1, 14, 15, 16, 17) with respect to each other, tempering each hollow grating plate (1, 14, 15, 16, 17) with a liquid medium that flows through an interior of each hollow grating (1, 14, 15, 16, 17), supplying primary air from below the pusher incineration grate through a plurality of pipe-shaped elements (21) having one of a circular, an elliptical and a slit-shaped cross section, which extend the pusher incineration grate, and individually metering the primary air for each pipe-shaped element (21).

2. A process in accordance with claim 1, further comprising controlling the primary air supply of each pipe-shaped element (21) with a microprocessor as a function of a temperature detected in an area of an upper outlet of the pipe-shaped element (21), whereby a combustion chamber temperature spectrum approaches a predeterminable temperature spectrum.

3. A process in accordance with claim 2, further comprising exchanging heat between the liquid medium and at least one of the primary air and an incineration exhaust air.

4. A process in accordance with claim 1, further comprising exchanging heat between the liquid medium and at least one of the primary air and an incineration exhaust air.

5. A grating plate (1) of a grating stage of a pusher incineration grate for incinerating, stoking and conveying garbage comprising a generally square hollow body of sheet metal, the generally square hollow body having a first sheet metal half-shell (2) having a first hollow side, a second sheet metal half-shell (3) having a second hollow side the first hollow side and the second hollow side positioned to face each other and welded together at edges turned into each other, at least one supply connector (6) positioned on an underside of the generally square hollow body, and at least one exhaust connector (7) positioned on the underside of the generally square hollow body, for the supply and exhaust of a medium flowing through the generally square hollow body; and a plurality of pipe-shaped elements (21) having one of a circular, an elliptical and a slit-shaped cross section positioned within and extending through the generally square hollow body for a supply of primary air from a direction of the underside of the generally square hollow body, and end portions of each pipe-shaped element (21) connected flash and sealingly with a surface of the generally square hollow body.

6. A grating plate (1) in accordance with claim 5, wherein a plurality of baffles for making a labyrinth are positioned in an interior of the generally square hollow body, through which the medium forcibly flows for improving heat exchange.

7. A grating plate (1) in accordance with claim 6, wherein at least one separating plate (50) divides the interior of the generally square hollow body into a plurality of sealed chambers (51, 52), the at least one supply connector (6) and the at least one exhaust connector (7) for the supply and exhaust of a medium positioned on an underside of each sealed chamber (51, 52).

8. A grating plate (1) in accordance with claim 5, the generally square hollow body further comprising a one-piece hollow profiled section sealed at two ends, a plurality of pipe-shaped elements (21) having one of a round, an elliptical and a slit-shaped cross section positioned within and extending through the generally square hollow body for a supply of primary air, and end portions of each pipe-shaped element (21) welded flush with a surface of the generally square hollow body.

9. A grating plate (1) in accordance with claim 5, wherein a plurality of baffles for making a labyrinth are positioned in an interior of the generally square hollow body, through which the medium forcibly flows for improving heat exchange.

10. A grating plate (1) in accordance with claim 5, wherein at least one separating plate (50) divides the interior of the generally square hollow body into a plurality of sealed chambers (51, 52), the at least one supply connector (6) and the at least one exhaust connector (7) for the supply and exhaust of a medium positioned on an underside of each sealed chamber (51, 52).

11. An incineration grate for incinerating garbage, comprising a plurality of grating plates (14, 15, 16, 17), wherein a length of the grating plates (14, 15, 16, 17) extends across an entire grate width of the incineration grate and respectively forms a grating stage, at least one grating plate overlapping and supported by a first adjoining grating plate, the at least one grating plate overlapped by and supporting a second adjoining grating plate, and each of the grating plates (1) being laterally guided on a plank (54), and the plank (54) having an interior through which a cooling medium can flow.

12. An incineration grate, in accordance with claim 11, further comprising a plurality of grating stages, each grating stage comprising a plurality of grating plates (14, 15, 16, 17) which are aligned adjacent to each other.

13. An incineration grate in accordance with claim 11, further comprising a plurality of grating stages, each alternating grating stage connected to mechanical drive means for moving back and forth each alternating grating stage in a plane of a surface with respect to an adjacent stationary grating stage, wherein a direction of movement of the grating stage extends in and opposite to a fall line on an inclined surface of the grating stages.

14. An incineration grate in accordance with claim 13, wherein the incineration grate is one of a reverse pusher grate and a forward pusher grate and is one of horizontally, upwardly and downwardly inclined with respect to a conveying direction of a material to be incinerated.

15. An incineration grate in accordance with claim 14, comprising a plurality of pipe-shaped elements (21) positioned within and extending through each grating plate (1), a first end portion of each pipe-shaped element (21) positioned flush with a top surface of a grating plate (1), a second end portion of each pipe-shaped element (21) extending through a bottom surface of a grating plate (1), the second end portion of each pipe-shaped element (21) connected with a flexible line (43) to a primary air supply syphon (30), through which primary air can be pumped in a direction of the incineration grate by a supply line (41) in communication with the primary air supply syphon (30), the primary air supply syphon (30) having a flap (31) positioned on a bottom of the primary air supply syphon (30) which can be actuated by a solenoid (37) for emptying out grate fall-through (40) collected within the primary air supply syphon (30).

16. An incineration grate in accordance with claim 11, comprising a plurality of pipe-shaped elements (21) positioned within and extending through each grating plate (1), a first end portion of each pipe-shaped element (21) positioned flush with a top surface of a grating plate (1), a second end portion of each pipe-shaped element (21) extending through a bottom surface of a grating plate (1), the second end portion of each pipe-shaped element (21) connected with a flexible line (43) to a primary air supply syphon (30), through which primary air can be pumped in a direction of the incineration grate by a supply line (41) in communication with the primary air supply syphon (30), the primary air supply syphon (30) having a flap (31) positioned on a bottom of the primary air supply syphon (30) which can be actuated by a solenoid (37) for emptying out grate fall-through (40) collected within the primary air supply syphon (30).

* * * * *